US011555231B2

(12) United States Patent
Oliver et al.

(10) Patent No.: US 11,555,231 B2
(45) **Date of Patent: *Jan. 17, 2023**

(54) DUPLEX STAINLESS STEEL

(75) Inventors: James Oliver, Fjärdhundra (SE); Jan Y. Jonsson, Avesta (SE); Alexander Thulin, Luleå (SE)

(73) Assignee: OUTOKUMPU OYJ, Helsinki (FI)

( * ) Notice: Subject to any disclaimer, the term of this patent is extended or adjusted under 35 U.S.C. 154(b) by 389 days.

This patent is subject to a terminal disclaimer.

(21) Appl. No.: 14/342,865

(22) PCT Filed: Sep. 5, 2012

(86) PCT No.: PCT/FI2012/050858

§ 371 (c)(1),
(2), (4) Date: Mar. 5, 2014

(87) PCT Pub. No.: WO2013/034804

PCT Pub. Date: Mar. 14, 2013

(65) Prior Publication Data

US 2014/0219856 A1 Aug. 7, 2014

(30) Foreign Application Priority Data

Sep. 7, 2011 (FI) ..... 20110291

(51) Int. Cl.

| | |
|---|---|
| ***C22C 38/40*** | (2006.01) |
| ***C22C 38/02*** | (2006.01) |
| ***C22C 38/42*** | (2006.01) |
| ***C22C 38/44*** | (2006.01) |
| ***C22C 38/00*** | (2006.01) |
| ***C22C 38/04*** | (2006.01) |
| ***C21D 6/00*** | (2006.01) |
| ***C22C 38/58*** | (2006.01) |
| *C22C 38/22* | (2006.01) |

(52) U.S. Cl.

CPC ..... *C22C 38/40* (2013.01); *C21D 6/004* (2013.01); *C22C 38/001* (2013.01); *C22C 38/02* (2013.01); *C22C 38/04* (2013.01); *C22C 38/42* (2013.01); *C22C 38/44* (2013.01); *C22C 38/58* (2013.01); *C21D 2211/001* (2013.01); *C21D 2211/005* (2013.01); *C22C 38/22* (2013.01)

(58) Field of Classification Search

CPC ..... C22C 38/04

See application file for complete search history.

(56) References Cited

U.S. PATENT DOCUMENTS

| | | | | |
|---|---|---|---|---|
| 6,344,094 | B1 * | 2/2002 | Hineno | C21D 6/004 148/325 |
| 2005/0211344 | A1 * | 9/2005 | Omura | C22C 38/001 148/542 |

FOREIGN PATENT DOCUMENTS

| | | | | |
|---|---|---|---|---|
| EP | 1061151 | A1 | 12/2000 | |
| EP | 1561834 | A1 | 8/2005 | |
| EP | 2 258 885 | A1 | 12/2010 | |
| EP | 2258885 | A1 | 12/2010 | |
| FI | 20100178 | A | 10/2011 | |
| JP | 2001115236 | A | 4/2001 | |
| JP | 2006-183129 | A | 7/2006 | |
| JP | 2009052115 | A | 8/2009 | |
| WO | WO-2008088282 | A1 * | 7/2008 | C22C 38/40 |

OTHER PUBLICATIONS

McGuire, Michael F.. (2008). Stainless Steels for Design Engineers. ASM International, pp. 91-107.*

International Search Report for PCT/FI2012/050858 completed Nov. 14, 2012, dated Nov. 16, 2012, 3 pages.

Andersson, R., Deformation Characteristics of Stainless Steel, Doctoral Thesis, pp. i-131, Dec. 2005, Lulea University of Technology, Dept. of App. Physics and Mech. Eng., Lulea, Sweden.

Oshima, T. et al., Efforts to Save Nickel in Austenitic Stainless Steels, pp. 359-364, ISIJ International,vol. 47 (2007), No.3.

Extended European Search Report prepared by the European Patent Office for EP 2753724; dated Aug. 20, 2015, 3 pages.

Tavares, SSM et al., "Microstructural changes produced by plastic deformation in the UNS S31803 duplex stainless steel," Journal of Materials Processing Technology, Elsevier NL, Jul. 7, 2006, vol. 180, No. 1-3, pp. 318-322.

* cited by examiner

*Primary Examiner* — Jophy S. Koshy
(74) *Attorney, Agent, or Firm* — Quinn IP Law

(57) ABSTRACT

The invention relates a duplex ferritic austenitic stainless steel having high formability utilizing the TRIP effect and high corrosion resistance with the balanced pitting resistance equivalent. The duplex stainless steel contains less than 0.04 weight % carbon, less than 0.7 weight % silicon, less than 2.5 weight % manganese, 18.5-22.5 weight % chromium, 0.8-4.5 weight % nickel, 0.6-1.4 weight % molybdenum, less than 1 weight % copper, 0.10-0.24 weight % nitrogen, the rest being iron and inevitable impurities occurring in stainless steels.

15 Claims, 2 Drawing Sheets

DUPLEX STAINLESS STEEL

CROSS-REFERENCE TO RELATED APPLICATION

Figure 1:
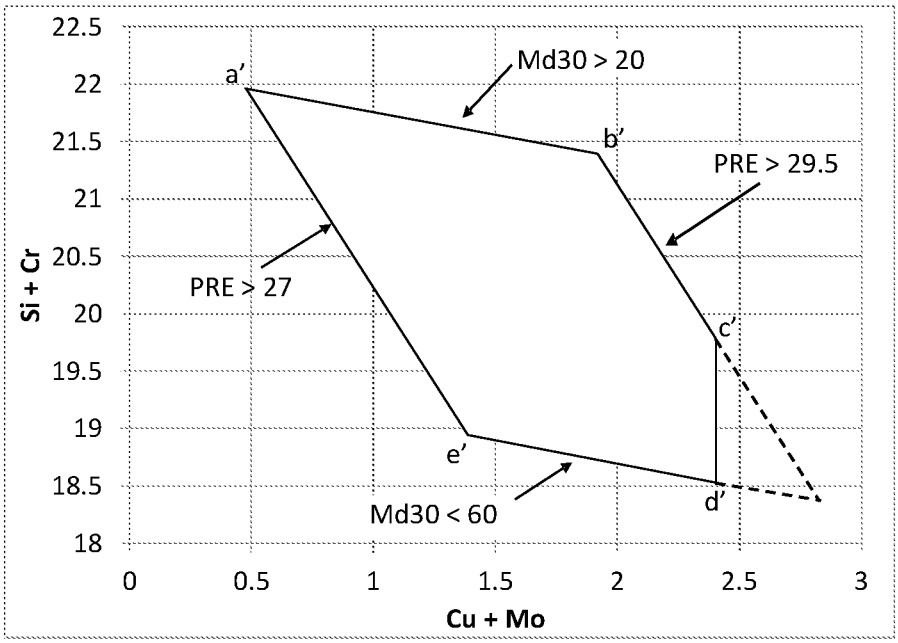

This is a national stage application filed under 35 USC 371 based on International Application No. PCT/FI2012/050858 filed Sep. 5, 2012, and claims priority under 35 USC 119 of Finnish Patent Application No. 20110291 filed Sep. 7, 2011.

This invention relates to a duplex ferritic austenitic stainless steel which has high formability with the TRIP (Transformation Induced Plasticity) effect and high corrosion resistance and optimized pitting resistance equivalent (PRE).

The transformation induced plasticity (TRIP) effect refers to the transformation of metastable retained austenite to martensite during plastic deformation as a result of imposed stress or strain. This property allows stainless steels having the TRIP effect to have a high formability, while retaining excellent strength.

It is known from the FI patent application 20100178 a method for manufacturing a ferritic-austenitic stainless steel having good formability and high elongation, which steel contains in weight % less than 0.05% C, 0.2-0.7% Si, 2-5% Mn, 19-20.5% Cr, 0.8-1.35% Ni, less than 0.6% Mo, less than 1% Cu, 0.16-0.24% N, the balance being iron and inevitable impurities. The stainless steel of the FI patent application 20100178 is heat treated so that the microstructure of the stainless steel contains 45-75% austenite in the heat treated condition, the remaining microstructure being ferrite. Further, the measured $M_{d30}$ temperature of the stainless steel is adjusted between 0 and 50° C. in order to utilize the transformation induced plasticity (TRIP) for improving the formability of the stainless steel. The $M_{d30}$-temperature, which is a measure for the austenite stability to the TRIP effect, is defined as the temperature at which 0.3 true strain yields 50% transformation of the austenite to martensite.

The object of the present invention is to improve the properties of the duplex stainless steel described in the FI patent application 20100178 and to achieve a new duplex ferritic austenitic stainless steel utilizing the TRIP effect with a new chemical composition wherein at least the contents of nickel and molybdenum and manganese are changed. The essential features of the invention are enlisted in the appended claims.

According to the invention, the duplex ferritic austenitic stainless steel contains less than 0.04 weight % C, less than 0.7 weight % Si, less than 2.5 weight % Mn, 18.5-22.5 weight % Cr, 0.8-4.5 weight % Ni, 0.6-1.4 weight % Mo, less than 1 weight % Cu, 0.10-0.24 weight % N, the rest being iron and inevitable impurities occurring in stainless steels. Sulphur is limited to less than 0.010 weight % and preferably less than 0.005 weight %, the phosphorus content is less than 0.040 weight % and the sum of sulphur and phosphorus (S+P) is less than 0.04 weight %, and the total oxygen content is below 100 ppm.

The duplex stainless steel of the invention optionally contains one or more added elements in the following: the aluminium content is maximized to less than 0.04 weight % and preferably the maximum is less than 0.03 weight %. Further, boron, calcium and cerium are optionally added in small quantities; the preferred contents for boron and calcium are less than 0.003 weight % and for cerium less than 0.1 weight %. Optionally cobalt can be added up to 1 weight % for a partial replacement to nickel, and tungsten can be added up to 0.5 weight % as partial replacement to molybdenum. Also one or more of the group containing niobium, titanium and vanadium can be optionally added in the duplex stainless steel of the invention, the contents of niobium and titanium being limited up to 0.1 weight % and the vanadium content being limited up to 0.2 weight %.

According to the stainless steel of the invention, the pitting resistance equivalent (PRE) has been optimized to give good corrosion resistance, being at the range of 27-29.5. The critical pitting temperature (CPT) is in the range of 20-33° C., preferably 23-31° C. The TRIP (Transformation Induced Plasticity) effect in the austenite phase is maintained in accordance with the measured $M_{d30}$ temperature at the range of 0-90° C., preferably at the range of 10-70° C., in order to ensure the good formability. The proportion of the austenite phase in the microstructure of the duplex stainless steel of the invention is in the heat treated condition 45-75 volume %, advantageously 55-65 volume %, the rest being ferrite, in order to create favourable conditions for the TRIP effect. The heat treatment can be carried out using different heat treatment methods, such as solution annealing, high-frequency induction annealing or local annealing, at the temperature range from 900 to 1200° C., preferably from 950 to 1150° C.

Effects of different elements in the microstructure are described in the following, the element contents being described in weight %:

Carbon (C) partitions to the austenite phase and has a strong effect on austenite stability. Carbon can be added up to 0.04% but higher levels have detrimental influence on corrosion resistance.

Nitrogen (N) is an important austenite stabilizer in duplex stainless steels and like carbon it increases the stability against martensite. Nitrogen also increases strength, strain hardening and corrosion resistance. The general empirical expressions on the $M_{d30}$ temperature indicate that nitrogen and carbon have the same strong influence on austenite stability. Because nitrogen can be added to stainless steels in larger extent than carbon without adverse effects on corrosion resistance the nitrogen contents from 0.10 up 0.24% are effective in present stainless steels. For the optimum property profile, the nitrogen content of 0.16-0.21% is preferable.

Silicon (Si) is normally added to stainless steels for deoxidizing purposes in the melt shop and should not be below 0.2%. Silicon stabilizes the ferrite phase in duplex stainless steels but has a stronger stabilizing effect on austenite stability against martensite formation than shown in current expressions. For this reason silicon is maximized to 0.7%, preferably to 0.5%.

Manganese (Mn) is an important addition to stabilize the austenite phase and to increase the solubility of nitrogen in the stainless steel. Manganese can partly replace the expensive nickel and bring the stainless steel to the right phase balance. Too high level in the content will reduce the corrosion resistance. Manganese has a stronger effect on austenite stability against deformation martensite therefore the manganese content must be carefully addressed. The range of manganese shall be less than 2.5%, preferably less than 2.0%.

Chromium (Cr) is the main addition to make the steel resistant to corrosion. Being ferrite stabilizer chromium is also the main addition to create a proper phase balance between the austenite phase and the ferrite phase. To bring about these functions the chromium level should be at least 18.5% and to restrict the ferrite phase to appropriate levels for the actual purpose the maximum content should be 22.5%. Preferably the chromium content is 19.0-22%, most preferably 19.5%-21.0%.

Nickel (Ni) is an essential alloying element for stabilizing the austenite phase and for good ductility and at least 0.8%, preferably at least 1.5% must be added to the steel. Having a large influence on austenite stability against martensite formation nickel has to be present in a narrow range. Further, because of nickel's high cost and price fluctuation nickel should be maximized in the present stainless steels to 4.5%, preferably to 3.5%, and more preferably 2.0-3.5%. Still more preferably, the nickel content should be 2.7-3.5%.

Copper (Cu) is normally present as a residual of 0.1-0.5% in most stainless steels, when the raw materials to a great deal are in the form of stainless scrap containing this element. Copper is a weak stabilizer of the austenite phase but has a strong effect on the resistance to martensite formation and must be considered in evaluation of formability of the present stainless steels. An intentional addition up to 1.0% can be made, but preferably the copper content is up to 0.7%, more preferably up to 0.5%.

Molybdenum (Mo) is a ferrite stabilizer that can be added to increase the corrosion resistance and, therefore, molybdenum shall be have a content more than 0.6%. Further, molybdenum increases the resistance to martensite formation, and together with other additions molybdenum cannot be added to more than 1.4%. Preferably, the molybdenum content is 1.0%-1.4%.

Boron (B), calcium (Ca) and cerium (Ce) are added in small quantities in duplex steels to improve hot workability and not at too high contents as this can deteriorate other properties. The preferred contents for boron and calcium are less than 0.003 weight % and for cerium less than 0.1 weight %.

Sulphur (S) in duplex steels deteriorates hot workability and can form sulphide inclusions that influence pitting corrosion resistance negatively. The content of sulphur should therefore be limited to less than 0.010 weight % and preferably less than 0.005 weight %.

Phosphorus (P) deteriorates hot workability and can form phosphide particles or films that influence corrosion resistance negatively. The content of phosphorus should therefore be limited to less than 0.040 weight %, and so that the sum of sulphur and phosphorus (S+P) contents is less than 0.04 weight %.

Oxygen (O) together with other residual elements has an adverse effect on hot ductility. For this reason it is important to control its presence to low levels, particularly for highly alloyed duplex grades that are susceptible to cracking. Presence of oxide inclusions may reduce corrosion resistance (pitting corrosion) depending on type of inclusion. High oxygen content also reduces impact toughness. In a similar manner as sulphur oxygen improves weld penetration by changing the surface energy of the weld pool. For the present invention the advisable maximum oxygen level is below 100 ppm. In a case of a metallic powder the maximum oxygen content can be up to 250 ppm.

Aluminium (Al) should be kept at a low level in the duplex stainless steel of the invention with high nitrogen content as these two elements can combine and form aluminium nitrides that will deteriorate the impact toughness. The aluminium content is limited to less than 0.04 weight % and preferably to less than 0.03 weight %.

Tungsten (W) has similar properties as molybdenum and can sometimes replace molybdenum, however tungsten can promote sigma phase precipitation and the content of tungsten should be limited up to 0.5 weight %.

Cobalt (Co) has similar metallurgical behaviour as its sister element, nickel, and cobalt may be treated in much the same way in steel and alloy production. Cobalt inhibits grain growth at elevated temperatures and considerably improves the retention of hardness and hot strength. Cobalt increases the cavitation erosion resistance and the strain hardening. Cobalt reduces the risk of sigma phase formation in super duplex stainless steels. The cobalt content is limited up to 1.0 weight %.

The "micro-alloying" elements titanium (Ti), vanadium (V) and niobium (Nb) belong to a group of additions so named because they significantly change the steels properties at low concentrations, often with beneficial effects in carbon steel but in the case of duplex stainless steels they also contribute to undesired property changes, such as reduced impact properties, higher surface defects levels and reduced ductility during casting and hot rolling. Many of these effects depend on their strong affinity for carbon and in particular nitrogen in the case of modern duplex stainless steels. In the present invention niobium and titanium should be limited to maximum level of 0.1% whereas vanadium is less detrimental and should be less than 0.2%.

Figure 2:
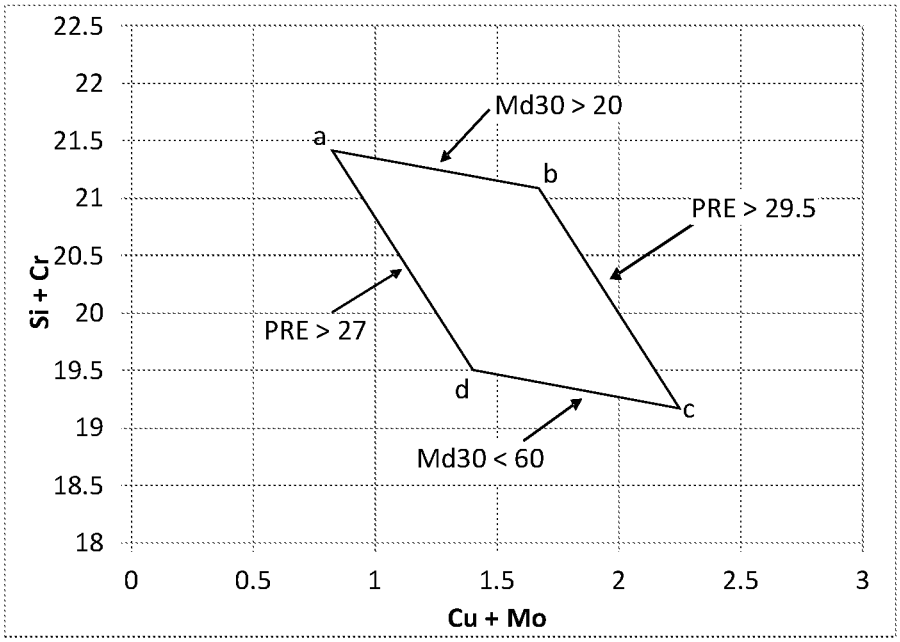
Figure 3:
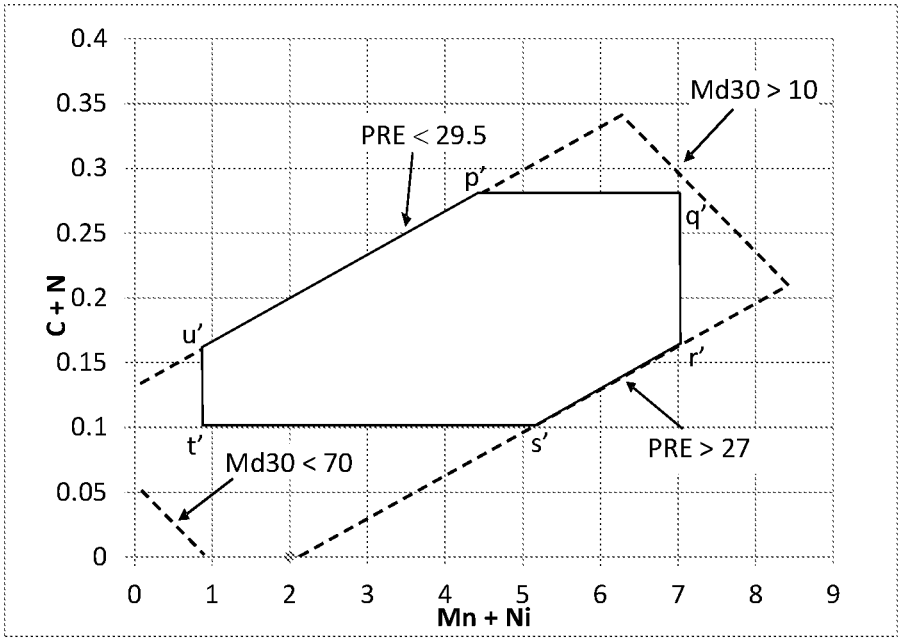
Figure 4:
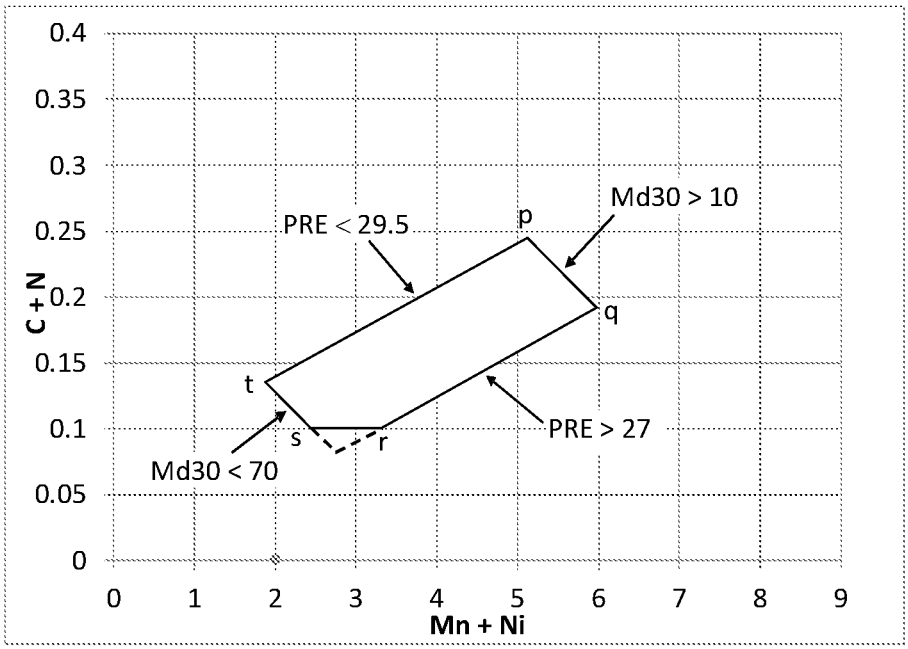

The present invention is described in more details referring to the drawings where FIG. 1 illustrates the dependence of the minimum and maximum $M_{d30}$ temperature and PRE values between the element contents Si+Cr and Cu+Mo in the tested alloys of the invention, FIG. 2 illustrates an example with constant values of C+N and Mn+Ni for the dependence of the minimum and maximum $M_{d30}$ temperature and PRE values between the element contents Si+Cr and Cu+Mo in the tested alloys of the invention according to FIG. 1, FIG. 3 illustrates the dependence of the minimum and maximum $M_{d30}$ temperature and PRE values between the element contents C+N and Mn+Ni in the tested alloys of the invention, and FIG. 4 illustrates an example with constant values of Si+Cr and Cu+Mo for the dependence of the minimum and maximum $M_{d30}$ temperature and PRE values between the element contents C+N and Mn+Ni in the tested alloys of the invention according to FIG. 3.

Based on the effects of the elements the duplex ferritic austenitic stainless steel according to the invention is presented with the chemical compositions A to G as named in the table 1. The table 1 contains also the chemical composition for the reference duplex stainless steel of the FI patent application 20100178 named as H, all the contents of the table 1 in weight %.

TABLE 1

| Alloy | C % | Si % | Mn % | Cr % | Ni % | Cu % | N % | Mo % |
|---|---|---|---|---|---|---|---|---|
| A | 0.03 | 0.30 | 0.50 | 20.7 | 4.0 | 0.42 | 0.165 | 1.27 |
| B | 0.023 | 0.29 | 1.4 | 20.4 | 3.5 | 0.41 | 0.162 | 0.99 |
| C | 0.024 | 0.28 | 1.36 | 20.6 | 2.7 | 0.42 | 0.18 | 1.14 |
| D | 0.02 | 0.37 | 1.82 | 19.6 | 1.7 | 0.42 | 0.198 | 1.17 |
| E | 0.021 | 0.31 | 0.76 | 20.1 | 2.9 | 0.42 | 0.194 | 1.19 |
| F | 0.017 | 0.33 | 0.83 | 19.8 | 3.1 | 0.41 | 0.19 | 1.2 |
| G | 0.026 | 0.46 | 0.99 | 20.08 | 3.03 | 0.36 | 0.178 | 1.19 |
| H | 0.04 | 0.40 | 3.0 | 20.2 | 1.2 | 0.40 | 0.22 | 0.40 |

The alloys A-F were manufactured in a vacuum induction furnace in 60 kg laboratory scale to small slabs that were hot rolled and cold rolled down to 1.5 mm thickness. The alloy G was produced in 100 ton production scale followed by hot rolling and cold rolling to coil form with varying final dimensions.

When comparing the values in the Table 1 the contents of carbon, nitrogen, manganese, nickel and molybdenum in the duplex stainless steels of the invention are significantly different from the reference stainless steel H.

The properties, the values for the $M_{d30}$ temperature, the critical pitting temperature (CPT) and the PRE were determined for the chemical compositions of the table 1 and the results are presented in the following table 2.

The predicted $M_{d30}$ temperature ($M_{d30}$ Nohara) of the austenite phase in the table 2 was calculated using the Nohara expression (1) established for austenitic stainless steels $$M_{d30}=551-462(C+N)-9.2Si-8.1Mn-13.7Cr-29(Ni+Cu)-18.5Mo-68Nb \quad (1)$$

when annealed at the temperature of 1050° C.

The actual measured $M_{d30}$ temperatures ($M_{d30}$ measured) of the table 2 were established by straining the tensile samples to 0.30 true strain at different temperatures and by measuring the fraction of the transformed martensite with Satmagan equipment. Satmagan is a magnetic balance in which the fraction of ferromagnetic phase is determined by placing a sample in a saturating magnetic field and by comparing the magnetic and gravitational forces induced by the sample.

The calculated $M_{d30}$ temperatures ($M_{d30}$ calc) in the table 2 were achieved in accordance with a mathematical constraint of optimization from which calculation the expressions (3) and (4) have also been derived.

The critical pitting temperature (CPT) is measured in a 1 M sodium chloride (NaCl) solution according to the ASTM G150 test, and below this critical pitting temperature (CPT) pitting is not possible and only passive behaviour is seen.

The pitting resistance equivalent (PRE) is calculated using the formula (2):

$$PRE=\%\ Cr+3.3*\%\ Mo+30*\%\ N-\%\ Mn \quad (2).$$

The sums of the element contents for C+N, Cr+Si, Cu+Mo and Mn+Ni in weight % are also calculated for the alloys of the table 1 in the table 2. The sums C+N and Mn+Ni represent austenite stabilizers, while the sum Si+Cr represents ferrite stabilizers and the sum Cu+Mo elements having resistance to martensite formation.

TABLE 2

| Alloy | C + N % | Si + Cr % | Mn + Ni % | Cu + Mo % | $M_{d30}$ calc ° C. | $M_{d30}$ Nohara ° C. | $M_{d30}$ measured ° C. | CPT ° C. | PRE % |
|---|---|---|---|---|---|---|---|---|---|
| A | 0.195 | 21 | 4.5 | 1.7 | 7.7 | −18.4 | 12.5 | 29.2 | 29.3 |
| B | 0.185 | 20.7 | 4.9 | 1.4 | 19.9 | 6.5 | 22 | 22.5 | 27.1 |
| C | 0.204 | 20.9 | 4.1 | 1.6 | 17.2 | −5.5 | 15.5 | 25.2 | 28.4 |
| D | 0.218 | 19.97 | 3.52 | 1.59 | 44.7 | 21.8 | 32.5 | — | 27.6 |
| E | 0.215 | 20.41 | 3.66 | 1.61 | 27.7 | 6.3 | 30.0 | 25.3 | 29.1 |
| F | 0.207 | 20.13 | 3.93 | 1.61 | 36.9 | −81 | 56.0 | 22.8 | 28.6 |
| G (1.5 mm) | 0.204 | 20.54 | 4.02 | 1.55 | 29.6 | 5 | 19 | 30.0 | 28.4 |
| G (2.5 mm) | 0.204 | 20.54 | 4.02 | 1.55 | 29.6 | 5 | 21 | 30.6 | 28.4 |
| H | 0.26 | 20.7 | 4.3 | 1.0 | 24.9 | 23 | 27 | <10 | 25 |

When comparing the values in the Table 2 the PRE value having the range of 27-29.5 is much higher than the PRE value in the reference duplex stainless steel H which means that the corrosion resistance of the alloys A-G is higher. The critical pitting temperature CPT is in the range of 21-32° C., which is much higher than the CPT for austenitic stainless steels, such as EN 1.4401 and similar grades.

The predicted $M_{d30}$ temperatures using the Nohara expression (1) are essentially different from the measured $M_{d30}$ temperatures for the alloys on the table 2. Further, from the table 2 it is noticed that the calculated $M_{d30}$ temperatures agree well with the measured $M_{d30}$ temperatures, and the mathematical constraint of optimization used for the calculation is thus very suitable for the duplex stainless steels of the invention.

The sums of the element contents for C+N, Si+Cr, Mn+Ni and Cu+Mo in weight % for the duplex stainless steel of the present invention were used in the mathematical constraint of optimization to establish the dependence in one hand between C+N and Mn+Ni, and in another hand between Si+Cr and Cu+Mo. In accordance with this mathematical constraint of optimization the sums of Cu+Mo and Si+Cr, respectively the sums Mn+Ni and C+N, form the x and y axis of a coordination in the FIGS. 1-4 where the linear dependence for the minimum and maximum PRE values (27<PRE<29.5) and for the minimum and maximum $M_{d30}$ temperature ($10<M_{d30}<70$) values are defined.

In accordance with FIG. 1 a chemical composition window for Si+Cr and Cu+Mo is established with the preferred ranges of 0.175-0.215 for C+N and 3.2-5.5 for Mn+Ni when the duplex stainless steel of the invention was annealed at the temperature of 1050° C. It is also noticed in FIG. 1 a limitation of Cu+Mo<2.4 because of the maximum ranges for copper and molybdenum.

The chemical composition window, which lies within the frame of the area a', b', c', d' and e' in FIG. 1, is defined with the following labelled positions of the coordination in the table 3.

TABLE 3

| | Si + Cr % | Cu + Mo % | C + N % | Mn + Ni % |
|---|---|---|---|---|
| a' | 22.0 | 0.45 | 0.175 | 3.2 |
| b' | 21.4 | 1.9 | 0.175 | 3.2 |
| c' | 19.75 | 2.4 | 0.21 | 3.3 |
| d' | 18.5 | 2.4 | 0.215 | 5.5 |
| e' | 18.9 | 1.34 | 0.215 | 5.5 |

FIG. 2 illustrates one chemical composition example window of FIG. 1 when constant values of 0.195 for C+N and 4.1 for Mn+Ni are used at all points instead of the ranges for C+N and Mn+Ni in FIG. 1. The chemical composition window, which lies within the frame of the area a, b, c and d in FIG. 2, is defined with the following labelled positions of the coordination in the table 4.

TABLE 4

| | Si + Cr % | Cu + Mo % | C + N % | Mn + Ni % |
|---|---|---|---|---|
| a | 21.40 | 0.80 | 0.195 | 4.1 |
| b | 20.10 | 1.60 | 0.195 | 4.1 |

TABLE 4-continued

| | Si + Cr % | Cu + Mo % | C + N % | Mn + Ni % |
|---|---|---|---|---|
| c | 19.15 | 2.25 | 0.195 | 4.1 |
| d | 19.50 | 1.40 | 0.195 | 4.1 |

FIG. 3 illustrates a chemical composition window for C+N and Mn+Ni with the preferred composition ranges 19.7-21.45 for Cr+Si and 1.3-1.9 for Cu+Mo, when the duplex stainless steel was annealed at the temperature of 1050° C. Further, in accordance with invention the sum C+N is limited to 0.1<C+N<0.28 and the sum Mn+Ni is limited to 0.8<Mn+Ni<7.0. The chemical composition window, which lies within the frame of the area p', q' r', s', t' and u' in FIG. 3, is defined with the following labelled positions of the coordination in the table 5.

TABLE 5

| | Si + Cr % | Cu + Mo % | C + N % | Mn + Ni % |
|---|---|---|---|---|
| p' | 20.4 | 1.8 | 0.28 | 4.3 |
| q' | 19.8 | 1.3 | 0.28 | 7.0 |
| r' | 20.2 | 1.7 | 0.17 | 7.0 |
| s' | 20.1 | 1.7 | 0.10 | 5.2 |
| t' | 20.9 | 1.9 | 0.10 | 1.5 |
| u' | 20.6 | 1.9 | 0.16 | 0.8 |

The effect of the limitations for C+N and Mn+Ni with the preferred ranges for the element contents of the invention is that the chemical composition window of FIG. 3 is partly limited by the PRE maximum and minimum values and partly limited by the limitations for C+N and Mn+Ni.

FIG. 4 illustrates one chemical composition example window of FIG. 3 with the constant values of 20.5 for Cr+Si and 1.6 for Cu+Mo and further, with the limitation of 0.1<C+N. The chemical composition window, which lies within the frame of the area p, q, r, s, t and u in FIG. 4, is defined with the following labelled positions of the coordination in the table 6.

TABLE 6

| | Si + Cr % | Cu + Mo % | C + N % | Mn + Ni % |
|---|---|---|---|---|
| p | 20.5 | 1.6 | 0.24 | 5.1 |
| q | 20.5 | 1.6 | 0.19 | 6.0 |
| r | 20.5 | 1.6 | 0.10 | 3.2 |
| s | 20.5 | 1.6 | 0.10 | 2.4 |
| t | 20.5 | 1.6 | 0.13 | 1.8 |

Using the values of the table 2 and the values of the FIGS. 1-4 the following expressions for the minimum and maximum $M_{d30}$ temperature values are established $$19.14-0.39(Cu+Mo)<(Si+Cr)<22.45-0.39(Cu+Mo) \quad (3)$$

$$0.1<(C+N)<0.78-0.06(Mn+Ni) \quad (4)$$

when the duplex stainless steel of the invention is annealed at the temperature range of 950-1150° C.

The alloys of the present invention as well as the reference material H above were further tested by determining the yield strengths $R_{p0.2}$ and $R_{p1.0}$ and the tensile strength $R_m$ as well as the elongation values for $A_{50}$, $A_5$ and $A_g$ both in the longitudinal (long) direction (alloys A-C, G-H) and in the transverse (trans) direction (all alloys A-H). The table 7 contains the results of the tests for the alloys A-G of the invention as well as the respective values for the reference H duplex stainless steel.

TABLE 7

| Alloy | $R_{p0.2}$ (MPa) | $R_{p1.0}$ (MPa) | $R_m$ (MPa) | $A_{50}$ (%) | $A_5$ (%) | $A_g$ (%) |
|---|---|---|---|---|---|---|
| A trans | 549.0 | 594.0 | 777.0 | 37.9 | 41.4 | 33.4 |
| A long | 527.8 | 586.0 | 797.3 | 40.0 | 44.0 | 34.6 |
| B long | 479.7 | 552.0 | 766.7 | 40.8 | 44.5 | 36.9 |
| C trans | 550.3 | 594.0 | 757.5 | 38.3 | 42.1 | 31.0 |
| C long | 503.8 | 583.0 | 772.3 | 42.5 | 46.7 | 34.6 |
| D trans 1050° C. | 526 | 577 | 811 | 41.6 | 45.7 | 37.4 |
| D trans 1120° C. | 507 | 561 | 786 | 44.0 | 48.3 | 39.8 |
| E trans 1050° C. | 540 | 588 | 810 | 44.0 | 48.2 | 38.8 |
| E trans 1120° C. | 517 | 572 | 789 | 43.6 | 47.8 | 38.5 |
| F trans 1050° C. | 535 | 577 | 858 | 37.2 | 40.8 | 34.7 |
| F trans 1120° C. | 499 | 556 | 840 | 39.8 | 43.7 | 35.9 |
| G 1.5 mm trans | 596 | 648 | 784 | 37.1 | 40.8 | 30.8 |
| G 1.5 mm long | 562 | 626 | 801 | 40.4 | 44.3 | 35.5 |
| G 2.5 mm trans | 572 | 641 | 793 | 40.7 | 43.3 | 34.9 |
| G 2.5 mm long | 557 | 622 | 805 | 43.3 | 45.9 | 37.6 |
| H trans | 493.7 | 543.7 | 757.3 | 44.6 | 48.6 | 40 |
| H long | 498.0 | 544.0 | 787.0 | 45.2 | 49.0 | 40 |

The results in the table 7 show that the yield strength values $R_{p0.2}$ and $R_{p1.0}$ for the alloys A-G are much higher than the respective values for the reference duplex stainless steel H, and the tensile strength value $R_m$ is similar to the reference duplex stainless steel H. The elongation values $A_{50}$, $A_5$ and $A_g$ of the alloys A to G are lower than the respective values for the reference stainless steel.

The duplex ferritic austenitic stainless steel of the invention can be produced as ingots, slabs, blooms, billets and flat products such as plates, sheets, strips, coils, and long products such as bars, rods, wires, profiles and shapes, seamless and welded tubes and/or pipes. Further, additional products such as metallic powder, formed shapes and profiles can be produced.

The invention claimed is:

1. A duplex ferritic austenitic stainless steel, heat treated at a temperature of 950° C. to 1150° C., the stainless steel having 35 volume %-44 volume % ferrite, the rest being austenite, wherein the stainless steel contains less than 0.04 weight % carbon, less than 0.7 weight % silicon, less than 2.0 weight % manganese, 18.5-22.5 weight % chromium, 1.5-3.5 weight % nickel, 0.99-1.4 weight % molybdenum, less than 1 weight % copper, 0.16-0.21 weight % nitrogen, greater than 0-0.5 weight % tungsten, the rest being iron and inevitable impurities, the stainless steel having:

a measured $M_{d30}$ temperature value of 10-70° C., a pitting resistance equivalent value (PRE) of 27-29.5, wherein PRE=[Cr]+3.3[Mo]+30 [N]−[Mn], wherein [Cr], [Mo], [N] and [Mn] represent the contents of Cr, Mo, N and Mn in weight %, a tensile strength $R_m$ in a longitudinal direction within a range of 766.7-805 MPa, and a critical pitting temperature CPT of 20-33° C.

2. The duplex ferritic austenitic stainless steel according to claim 1, wherein the chromium content is 19.0-22 weight %.

3. The duplex ferritic austenitic stainless steel according to claim 1, wherein the copper content is up to 0.7 weight %.

4. The duplex ferritic austenitic stainless steel according to claim 1, wherein the stainless steel contains one or more added elements: less than 0.04 weight % Al, less than 0.003 weight % B, less than 0.003 weight % Ca, less than 0.1 weight % Ce, up to 1 weight % Co, up to 0.1 weight % Nb, up to 0.1 weight % Ti, up to 0.2 weight % V.

5. The duplex ferritic austenitic stainless steel according to claim 1, wherein the stainless steel has a chemical composition window defined by weight % as:

Si+Cr % being within a range of 18.5-21.9;

Cu+Mo % being within a range of 1.36-2.394;

C+N % being within a range of 0.175-0.215; and

Mn+Ni % being within a range of 1.5-<2.9.

6. The duplex ferritic austenitic stainless steel according to claim 1, wherein the stainless steel has a chemical composition window defined by weight % as:

Si+Cr % being within a range of 19.8-20.9;

Cu+Mo % being within a range of 1.7-1.9;

C+N % being within a range of 0.20-<0.25; and

Mn+Ni % being within a range of 1.5-<2.9.

7. The duplex ferritic austenitic stainless steel according to the claim 1, wherein the stainless steel is produced as ingots, slabs, blooms, billets, plates, sheets, strips, coils, bars, rods, wires, profiles and shapes, seamless and welded tubes and/or pipes, metallic powder, formed shapes and profiles.

8. The duplex ferritic austenitic stainless steel according to claim 1, the stainless steel contains less than 0.010 weight % sulfur (S), less than 0.040 weight % phosphorous (P), and oxygen content below 100 ppm, wherein the sum (S+P) is less than 0.04 weight %.

9. The duplex ferritic austenitic stainless steel according to claim 1, the stainless steel having a yield strength $R_{p0.2}$ in a longitudinal direction within a range of 479.7-562 MPa.

10. The duplex ferritic austenitic stainless steel according to claim 1, the stainless steel having a yield strength $R_{p1.0}$ in a longitudinal direction within a range of 552-626 MPa.

11. The duplex ferritic austenitic stainless steel according to claim 1, the stainless steel having an elongation value $A_g$ in a longitudinal direction within a range of 34.6%-37.6%.

12. The duplex ferritic austenitic stainless steel according to claim 1, the stainless steel having a tensile strength $R_m$ in a transverse direction within a range of 757.5-858 MPa.

13. The duplex ferritic austenitic stainless steel according to claim 1, the stainless steel having a yield strength $R_{p0.2}$ in a transverse direction within a range of 499-596 MPa.

14. The duplex ferritic austenitic stainless steel according to claim 1, the stainless steel having a yield strength $R_{p1.0}$ in a transverse direction within a range of 556-648 MPa.

15. The duplex ferritic austenitic stainless steel according to claim 1, the stainless steel having an elongation value $A_g$ in a transverse direction within a range of 30.8%— 39.8%.

* * * * *